US006543542B2

(12) United States Patent
Tieben

(10) Patent No.: US 6,543,542 B2
(45) Date of Patent: Apr. 8, 2003

(54) CRUDE OIL RECOVERY SYSTEM

(75) Inventor: James B. Tieben, Dodge City, KS (US)

(73) Assignee: My-D Han-D Co., Dodge City, KS (US)

( * ) Notice: Subject to any disclaimer, the term of this patent is extended or adjusted under 35 U.S.C. 154(b) by 0 days.

(21) Appl. No.: 09/846,142

(22) Filed: Apr. 30, 2001

(65) Prior Publication Data

US 2002/0157822 A1 Oct. 31, 2002

(51) Int. Cl.[7] ..... E21B 43/00
(52) U.S. Cl. ..... 166/369; 166/68; 166/106
(58) Field of Search ..... 166/369, 372, 166/68, 68.5, 106, 110

(56) References Cited

U.S. PATENT DOCUMENTS

| | | | | |
|---|---|---|---|---|
| 642,012 A | | 1/1900 | Shaw | |
| 1,808,985 A | | 6/1931 | Helmling | |
| 2,079,996 A | | 5/1937 | Humason | |
| 2,886,108 A | | 5/1959 | Piety | |
| 2,982,355 A | * | 5/1961 | Rodgers | 166/68.5 |
| 4,666,375 A | * | 5/1987 | Kime | 417/46 |
| 4,711,299 A | | 12/1987 | Caldwell et al. | 166/105.1 |
| 4,778,355 A | * | 10/1988 | Holland | 417/378 |
| 5,058,680 A | * | 10/1991 | Huber et al. | 166/297 |
| 2002/0007952 A1 | * | 1/2002 | Vann | 166/369 |

* cited by examiner

*Primary Examiner*—William Neuder
(74) *Attorney, Agent, or Firm*—Brinks Hofer Gilson & Lione

(57) ABSTRACT

A crude oil recovery system includes a downhole pump and an extension that extends below the downhole pump. The extension has an extension inlet positioned below the lowest drawdown level achievable by the pump. All of the fluid pumped by the downhole pump enters the extension via the extension inlet, and by positioning the extension inlet sufficiently below the lowest drawdown level achievable by the pump, pressurized gas is prevented from entering the extension, the pump, or the pump column above the pump. In this way, gas is prevented from displacing oil in the pump column, thereby maintaining excellent cooling for the polish rod, and gas is confined to the borehole annulus, where it can readily be recovered or vented.

11 Claims, 2 Drawing Sheets

40
38
32
26
18
P
22
30
28
L2
L1
60
80
82
36
H
62
D
12
62

CRUDE OIL RECOVERY SYSTEM

BACKGROUND

This invention relates to an improved system for pumping crude oil from an earth formation, and in particular to such a system that reduces or eliminates the undesirable admission of gas into the pump column.

With conventional crude oil recovery systems, a downhole pump is positioned inside a borehole in an earth formation, and crude oil is drawn by suction through perforations just below the pump inlet. Crude oil and any salt water or gas passing through the perforations are drawn into the downhole pump and via the pump into the pump column. Natural gas that rises up the pump column is then routed to the battery tanks, where it is either vented to atmosphere or burned. If sufficient natural gas is being produced, it can be captured for distribution or for use in powering the engine driving the pump.

As the gas rises in the pump column, it expands and can build up sufficient pressure to force the column of oil above the expanding gas out of the well head. Once the expanding column of gas displaces oil in the pump column, the reciprocating polish rod that powers the downhole pump is deprived of contact with heat-dissipating oil. As a result, the polish rod can become very hot, and the rate of wear of the polish rod can substantially increase.

Thus, a need presently exists for an improved crude oil recovery system that reduces or eliminates the pumping of natural gas into the pump column.

SUMMARY

By way of general introduction, the crude oil recovery system illustrated in the drawings includes a downhole pump having a pump inlet and a pump outlet. An extension is provided that extends substantially below the pump inlet, and this extension is provided with an extension inlet. All of the fluid pumped by the pump passes through the extension inlet, and this extension inlet is positioned below the lowest level of crude oil in the borehole that is created by the pump. For this reason, the extension inlet remains submerged in the crude oil pooled in the borehole, and gas is prevented from entering the pump or the pump column. Instead, the gas pressurizes the borehole annulus, where it can readily be collected or vented.

DETAILED DESCRIPTION OF THE PRESENTLY PREFERRED EMBODIMENTS

Figure 1:
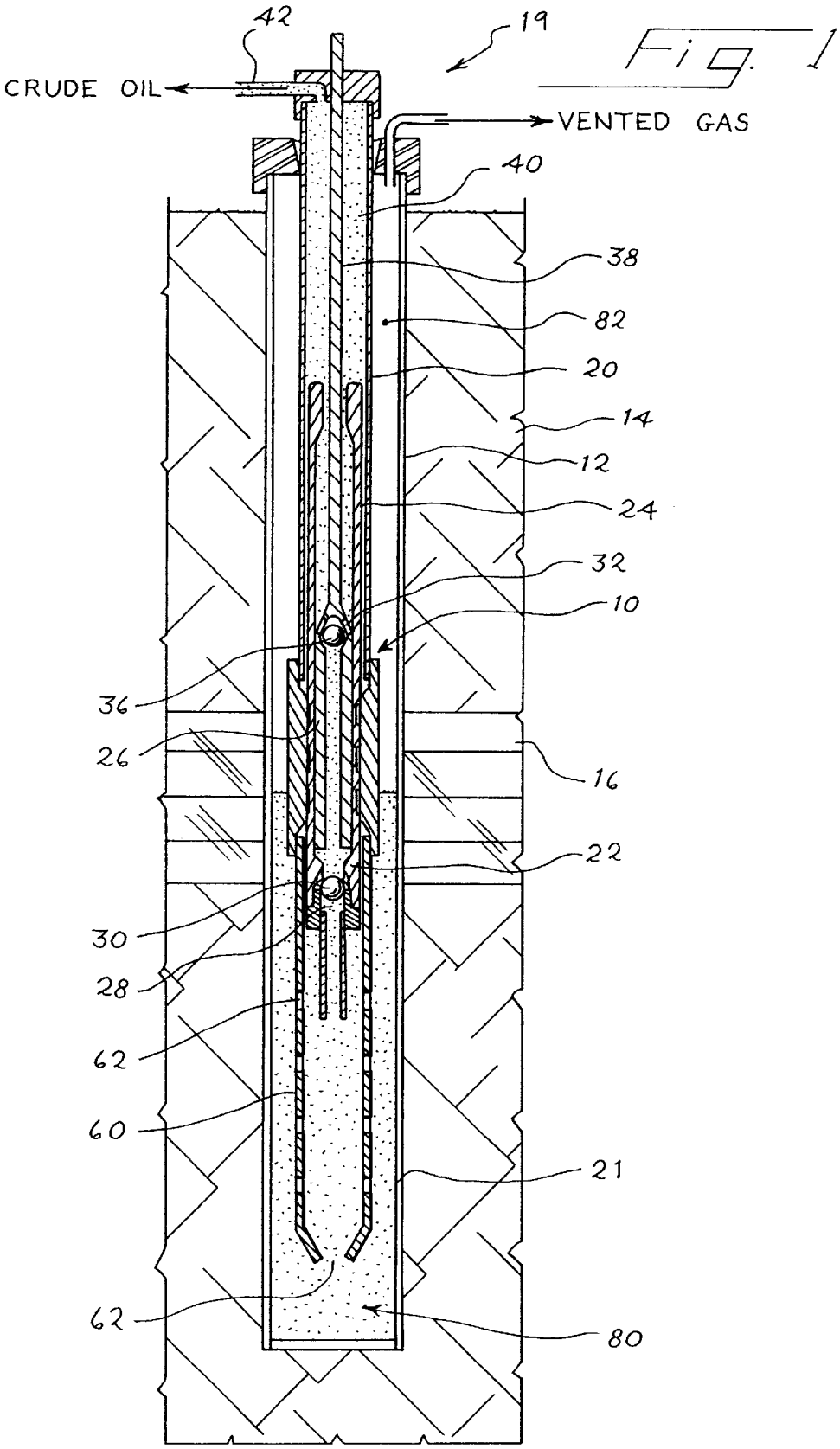
FIG. 1 is a cross-sectional view of a crude oil recovery system that incorporates a preferred embodiment of this invention, showing the pump plunger in a lower position.

Turning now to the drawings, FIG. 1 shows an overall view of a crude oil recovery system 10 that is positioned in a borehole 12 formed in an earth formation 14. The earth formation 14 includes an oil production zone 16, and crude oil 80 and natural gas 82 from the oil production zone 16 pass into the borehole 12. A well head 19 is positioned above ground, and a column of production tubing 20 is suspended from the well head 19.

The production tubing 20 carries at its lower end a downhole pump 22 that includes a pump body 24 and a plunger 26. In this embodiment the pump body 24 is formed as a tube configured to be lowered into the borehole 12, and the plunger 26 is configured as a tube configured to fit concentrically within the pump body 24.

The downhole pump 22 includes a pump inlet 28 at a lower check valve 30 carried by the pump body 22. The downhole pump 22 also includes a pump outlet 32 at an upper check valve 36 carried by the plunger 26. The plunger 26 is carried by a reciprocating polish rod 38 that passes out through the well head 19. An engine (not shown) reciprocates the polish rod 38, thereby moving the pump plunger 26 alternately upwardly and downwardly in the pump body 24. As the plunger 26 moves downwardly in the pump body 24, the lower check valve 30 closes, the upper check valve 36 opens, and oil positioned between the check valves 30, 36 passes around the upper check valve 36 into the pump column 40 defined by the production tubing 20 above the upper check valve 36.

When the plunger 26 is raised by the polish rod 38, the upper check valve 36 closes and the lower check valve 30 opens. The rising plunger 26 lifts oil in the pump column 40 and discharges oil at the crude oil outlet 42 for collection and distribution. The rising plunger 26 also draws crude oil into the pump body 22, past the lower check valve 30.

The elements 12 through 42 described above can be implemented using any suitable technology. For example, the production tubing 20 can be formed of any suitable tube or pipe, whether continuous or segmented. If segmented, the production tubing 20 can be joined together in any desired manner, as for example by threaded connections, welded connections, and the like. Similarly, the downhole pump 22 can take any desired form, and it is not limited to the simple example shown in the drawings. If desired, other types of downhole pumps can be used, including screw pumps and electric pumps, for example.

According to this invention, the crude oil recovery system 10 additionally includes an extension 60 that extends below the pump inlet 28. The extension 60 includes an extension inlet 62 positioned in this example near the bottom of the extension 60. The extension 60 includes no openings between the uppermost portion of the extension inlet 62 and the pump inlet 28. The extension inlet 60 can take many forms, and may include any desired combination of an open lower end and/or perforations in the side of the extension 60.

In this example, the extension 60 takes the form of a pipe or tube that is suspended from the production tubing 20 or alternatively from the pump body 24. It is not essential in all embodiments that the extension 60 be sealed directly to the pump body 24, and if desired the extension 60 can be supported by other downhole structures such as the casing 21.

Figure 2:
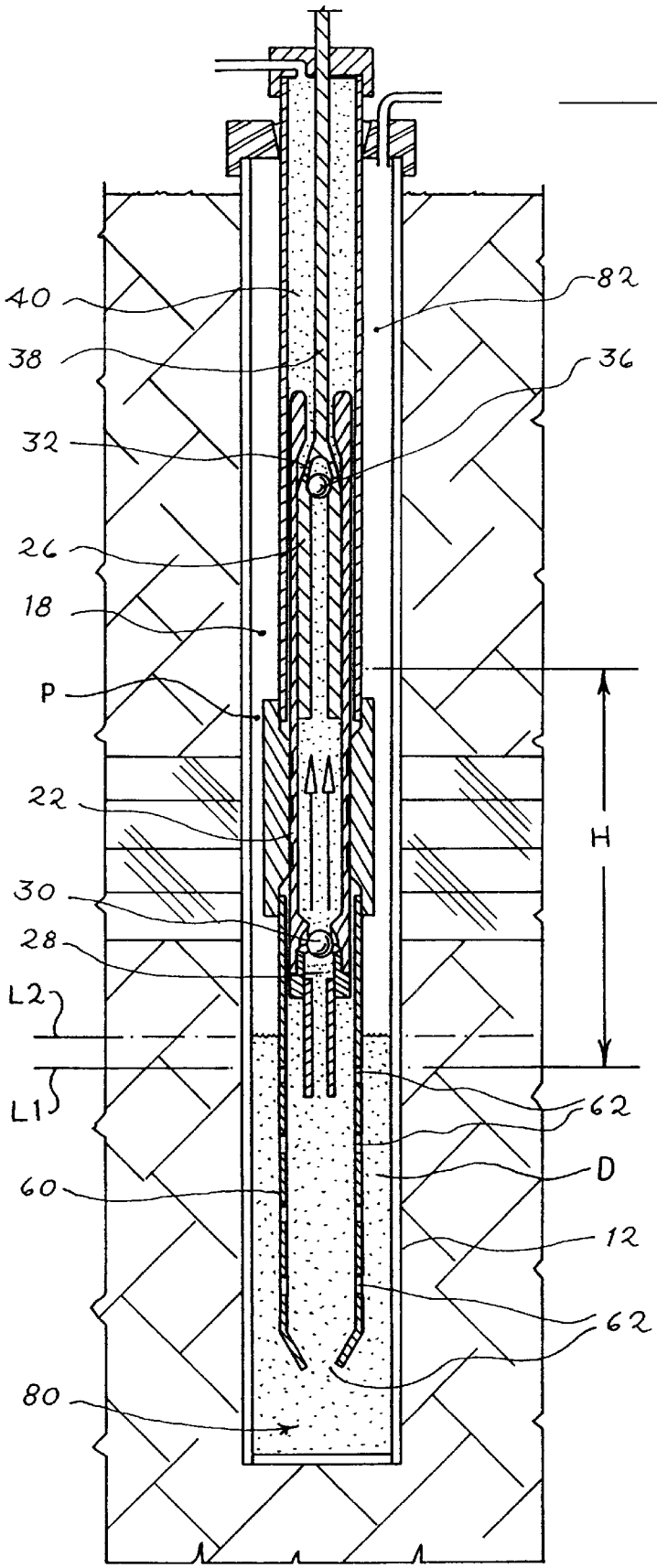
FIG. 2 is a cross-sectional view of the embodiment of FIG. 1, showing the pump plunger in an upper position.

As shown in FIG. 2, the uppermost portion of the extension inlet 62 is positioned at a level L1, and the downhole pump 22 is characterized by a lowest drawdown level L2 that is achievable for the currently-prevailing borehole annulus pressure P and crude oil density D. As shown in FIG. 2, this lowest drawdown level L2 is positioned above the level L1, and the downhole pump 22 is therefore incapable of drawing down the crude oil 80 in the borehole 12 to a sufficiently low level to allow gas 82 to enter any part of the extension inlet 62. In this way, the gas 82 is prevented from entering the extension 60, the pump inlet 28, or the pump column 40. For this reason, the polish rod 38 is maintained in a constant oil bath, thereby preventing overheating. Furthermore, since the gas 82 is prevented from entering the pump column 40, the gas 82 pressurizes the borehole annulus 18, thereby facilitating gas recovery from the annulus 18. Recovered gas can be accumulated for use in powering the engine that reciprocates the polish rod 38 or for distribution.

As explained above, the downhole pump 22 draws crude oil 80 past the lower check valve 30 as the plunger 26 is raised. The minimum drawdown level achievable by the downhole pump 22 is a function of the gas pressure P in the annulus 18 exerted on the crude oil 80 and the density D of the crude oil 80. In particular, the maximum vertical separation between the upper check valve 36 and the minimum draw down level L2 is approximately equal to P/D. The height H between the pump outlet 32 and the uppermost portion of the extension inlet 62 is maintained at a value greater than P/D, for all positions of the pump outlet 32 as the plunger 26 reciprocates. Note that in this example the pump outlet 32 moves upwardly and downwardly as the plunger 26 reciprocates, and the value H described above is measured with respect to the lowermost position of the plunger 26 and therefore of the pump outlet 32.

In most cases, the pressure P is no less than atmospheric pressure (14.7 psia or 1030 gm/cm$^2$), the density D is no greater than that of water (0.036 lb/in$^3$ or 1 gm/cm$^3$), and the height H is therefore greater than 34 feet (10.3 m). For example, in the case where the density D is 0.8 times that of water, the height H is greater than 42 feet (13 m). Thus, the height H can be greater than 34, 40, or 45 feet (10, 12 or 14 m). Even greater values for the height H can be used. For example, if the borehole is pressurized by the gas such that the pressure P is greater than the minimum pressure for a 5,000 ft (1,525 m) well by 10, 50, or 100 psi (700, 350 or 7,000 gm/cm$^2$), then the height H should be greater than 85, 200, and 300 feet (30, 61, and 91 m), respectively.

As described above, the extension 60 prevents the downhole pump 22 from drawing down the crude oil 80 to a level where any of the extension inlet 62 is directly exposed to the gas 82 in the borehole above the oil 80. This prevents the introduction of any substantial volume of gas into the extension 60, the downhole pump 22, and the pump column 40 as a result of pump operation. Of course, the oil 80 may include dissolved or suspended gas which may enter the extension 60 with the oil 80, but such dissolved or suspended gas is not a substantial volume of gas that adversely affects polish rod cooling.

The foregoing detailed description has described only a few of the many forms that this invention can take. For this reason, this detailed description is intended by way of illustration and not limitation. It is only the following claims, including all equivalents, that are intended to define the scope of this invention.

What is claimed is:

1. A crude oil recovery system installed in a borehole in an earth formation that passes through an oil production zone, said recovery system comprising:

a length of production tubing positioned in the borehole;

a downhole pump carried by the production tubing and positioned in the borehole, said pump comprising a pump inlet and a pump outlet, said pump outlet in fluid communication with a pump column defined by the production tubing, and said borehole comprising an annulus extending around said downhole pump;

a quantity of oil of density D gm/cm$^3$ disposed in said borehole annulus;

a gas above said, quantity of oil of pressure P gm/cm$^2$;

an extension extending downwardly from the pump inlet, said extension comprising an extension inlet and being free of openings between the pump inlet and the extension inlet such that said oil pumped by the downhole pump is drawn upwardly from the extension inlet before entering the pump, wherein the extension inlet is vertically spaced below the pump outlet by at least a minimum vertical distance H cm, and wherein H is greater than P/D such that the downhole pump is prevented by the extension from pumping oil at a rate sufficient to draw the oil in the borehole annulus to a level that permits the gas to enter the extension inlet, thereby preventing a substantial volume of the gas from flowing into the pump inlet and the pump column; and a reciprocating rod disposed in the pump column and coupled with the downhole pump to power the downhole pump.

2. A crude oil recovery system installed in a borehole in an earth formation that passes through an oil production zone, said recovery system comprising:

a length of production tubing positioned in the borehole;

a downhole pump carried by the production tubing and positioned in the borehole, said pump comprising a pump inlet and a pump outlet, said pump outlet in fluid communication with a pump column defined by the production tubing;

an extension extending downwardly from the pump inlet, said extension comprising an extension inlet and being free of openings between the pump inlet and the extension inlet such that oil pumped by the downhole pump is drawn upwardly from the extension inlet before entering the pump;

said extension inlet positioned entirely below a level L1;

a quantity of oil drawable by said downhole pump to a lowest level L2; and a gas above said quantity of oil of pressure P gm/cm$^2$;

wherein L2 is above L1 such that the downhole pump is prevented by the extension from pumping the oil at a rate sufficient to permit a substantial volume of the gas to enter the extension inlet, thereby preventing a substantial volume of the gas from flowing into the pump inlet and the pump column.

3. A method of recovering oil from a borehole in an earth formation comprising:

inserting a pump assembly into said borehole, wherein said pump assembly comprises a downhole pump comprising a pump inlet and a pump outlet, and an extension coupled with said downhole pump, said extension having an uppermost inlet, wherein said borehole and said downhole pump define an annulus therebetween;

maintaining said uppermost inlet of said extension entirely in a quantity of oil;

exerting a pressure on said oil with a gas;

pumping said oil upwardly through said downhole pump while preventing said gas from entering said downhole pump by said maintaining said uppermost inlet of said extension entirely in a quantity of oil; and recovering said gas through said annulus.

4. The method of claim 3 wherein said oil has a density of D gm/cm$^3$, wherein said pressure is P gm/cm$^2$, wherein said uppermost extension inlet is vertically spaced below said pump outlet by at least a minimum distance H cm, and wherein H is greater than P/D.

5. The method of claim 3 wherein said borehole comprises a casing and wherein said downhole pump comprises a production tube coupled thereto, wherein said casing and said production tube define at least in part said annulus.

6. The method of claim 5 further comprising a reciprocating rod disposed in the production tube and coupled to the downhole pump to power the downhole pump.

7. The method of claim 3 wherein said downhole pump comprises an upper check valve adjacent the pump outlet and a lower check valve adjacent the pump inlet.

8. A method of recovering oil from a borehole in an earth formation comprising:

inserting a pump assembly into said borehole, wherein said pump assembly comprises a downhole pump comprising a pump inlet and a pump outlet, and an extension coupled with said downhole pump, said extension having an uppermost inlet, wherein said borehole and said downhole pump define an annulus therebetween;

providing a quantity of oil having a density of D $gm/cm^3$ in said annulus;

exerting a pressure P $gm/cm^2$ on said oil with a gas;

maintaining said uppermost inlet of said extension at least at a minimum height H cm below said pump outlet, wherein H is greater than PD;

pumping said oil upwardly through said downhole pump while preventing said gas from entering said downhole pump by maintaining said uppermost inlet of said extension at said at least said minimum height H; and recovering said gas through said annulus.

9. The method of claim 8 wherein said borehole comprises a casing and wherein said downhole pump comprises a production tube coupled thereto, wherein said casing and said production tube define at least in part said annulus.

10. The method of claim 9 further comprising a reciprocating rod disposed in the production tube and coupled to the downhole pump to power the downhole pump.

11. The method of claim 8 wherein said downhole pump comprises an upper check valve adjacent the pump outlet and a lower check valve adjacent the pump inlet.

* * * * *

UNITED STATES PATENT AND TRADEMARK OFFICE

CERTIFICATE OF CORRECTION

PATENT NO. : 6,543,542 B2
DATED : April 8, 2003
INVENTOR(S) : James B. Tieben

It is certified that error appears in the above-identified patent and that said Letters Patent is hereby corrected as shown below:

Column 3,
Line 64, after “said” delete “,”.

Column 6,
Line 3, delete “PD;” and substitute -- P/D; -- in its place.

Signed and Sealed this

Fourth Day of May, 2004

JON W. DUDAS
*Acting Director of the United States Patent and Trademark Office*